United States Patent [19]

Scott

[11] 4,279,188

[45] Jul. 21, 1981

[54] ACOUSTIC COUPLING FREE ELECTRIC DRUM

[76] Inventor: Robert D. Scott, 1324 Glen Alan, West Covina, Calif. 91791

[21] Appl. No.: 77,597

[22] Filed: Sep. 21, 1979

[51] Int. Cl.[3] ..... G10H 3/06; H01C 10/10

[52] U.S. Cl. ..... 84/1.14; 84/411 A; 84/DIG. 12; 338/69; 338/114; 338/99

[58] Field of Search ..... 84/1.14, 1.15, 411 A, 84/411 R, 413, 415, DIG. 12; 179/1 M; 338/69, 99, 102, 114

[56] References Cited

U.S. PATENT DOCUMENTS

| | | | |
|---|---|---|---|
| 3,439,573 | 4/1969 | Zottolo | 84/411 A |
| 3,509,264 | 4/1970 | Green | 84/DIG. 12 |
| 3,629,774 | 12/1971 | Crites | 338/99 |
| 3,960,044 | 6/1976 | Nagai et al. | 338/114 |
| 4,201,107 | 5/1980 | Barber, Jr. et al. | 84/1.14 |
| 4,226,156 | 10/1980 | Hyakutake | 84/1.14 |
| 4,227,049 | 10/1980 | Thomson et al. | 179/1 M |

*Primary Examiner*—J. V. Truhe
*Assistant Examiner*—Forester W. Isen
*Attorney, Agent, or Firm*—Wagner & Bachand

[57] ABSTRACT

Faithful replication of a drummer's hits on an electric drum, free of cogeneration of spurious signals by acoustic coupling of the drum pick-up with extraneous energy sources such as nearby musical instruments is achieved by employing as the drum hit pick-up a variable resistance transducer comprising a foamed dielectric matrix, e.g. polymer, having electroconductive particles therein, sandwiched between conductive members one of which is contiguous with the drum head.

33 Claims, 9 Drawing Figures

INVENTION

ACOUSTIC COUPLING RESPONSE ONLY

DIRECT HIT RESPONSE ONLY

COMBINED ACOUSTIC COUPLING AND DIRECT HIT RESPONSE

SIMULTANEOUS TRACE OF ACOUSTIC COUPLING INPUTS TO PRIOR ART AND INVENTION PICK-UPS

ACOUSTIC COUPLING FREE ELECTRIC DRUM

BACKGROUND OF THE INVENTION

This invention has to do with musical instruments and more particularly is concerned with modern musical instruments of the type used to generate percussion based sounds and, more specifically, is concerned with electric drums adapted to input to percussion sound synthesizers.

Modern music requires the generation of percussion based sounds which are enhanced, distorted, processed, and amplified to highlight or fill out a musical composition. The drum is an ancient instrument capable of a relatively small range of sounds. Current electronic developments, however, permit the conversion of basic drum outputs into a wide variety of sounds ranging from the truly stacatto to electronic wails. Composers and performers thus are able to have a much greater spectrum of sounds at their disposal in composing and performing. Such drums may be likewise expected to generate the traditional sounds of the tuned drum, e.g. snare, wood block, and so on.

PRIOR ART

It is known to obtain a signal from the beating of the drum by positioning a pick-up such as a speaker cone within a drum chamber. The signal can then be amplified or processed to obtain the desired sound result. Numerous variations on this basic arrangement have been proposed including the location of the pick-up device on or below the drum head itself, in certain prior art patents, to wit the following:

| | | | |
|---|---|---|---|
| U.S. Pat. No. | 2,900,453 | Issued | August 18, 1959 |
| U.S. Pat. No. | 3,008,367 | Issued | November 14, 1961 |
| U.S. Pat. No. | 3,064,089 | Issued | November 13, 1962 |
| U.S. Pat. No. | 3,439,568 | Issued | April 22, 1969 |
| U.S. Pat. No. | 3,509,264 | Issued | April 28, 1970 |
| U.S. Pat. No. | 3,551,580 | Issued | December 29, 1970 |
| U.S. Pat. No. | 3,553,339 | Issued | January 5, 1971 |
| U.S. Pat. No. | 3,659,032 | Issued | April 25, 1972 |
| U.S. Pat. No. | 3,725,561 | Issued | April 3, 1973 |
| U.S. Pat. No. | 3,748,367 | Issued | July 24, 1973 |
| U.S. Pat. No. | 3,956,959 | Issued | May 18, 1976 |
| U.S. Pat. No. | 4,030,396 | Issued | June 21, 1977 |
| U.S. Pat. No. | 4,119,007 | Issued | October 10, 1978 |

The problem with prior art electric drum devices is a lack of ability to discriminate between sounds desired to be signal generating and other sounds not so wanted. Thus in a typical band situation, the drummer is placed with the other instrument performers only to find that the guitar and other instrument sounds are sensed by the drum pick-up and are signal generating in a manner deleterious to the production of the intended sound of the band. This tendency is attempted to be blocked by locating the drums in a relatively remote place, by turning down the amplification of the electric drum system, or through use of filters to screen out unwanted signal generation. None of these expedients to my knowledge has solved the problem; electric drums currently available and known are responsive to spurious acoustic energy as well as to intended energy inputs from drum heads, through the phenomenon of acoustic coupling, because known electrical devices have themselves relied upon acoustic coupling to generate their signal.

Until a dramatically different pick-up is devised one not relying on acoustic coupling for operation, electric drums will be plagued with these problems.

Applicant has devised a novel pick-up which is direct pressure, drum hit responsive and which blocks acoustic coupling response.

SUMMARY OF THE INVENTION

It is, accordingly, an object of the present invention to provide a novel electric drum. It is a further object to provide an electric drum which is signal generating in acoustic coupling-free relation. It is a further object of the invention to provide an electromechanical transducer adapted for use in an electric drum for selective response to drum hits and freely of acoustic coupling. Other objects will appear hereinafter.

The foregoing and other objects of the invention to become apparent hereinafter are realized through provision in accordance with the invention of an acoustic coupling-free, variable resistance electromechanical transducer comprising opposed first and second conductive members assembled in surface contact with and spaced by an electroconductive material impregnated, resilient, dielectric matrix responsive to direct pressure and nonresponsive to acoustic pressure, in resistance varying relation between the conductors.

There is thus provided in one embodiment of the invention a variable resistance electromechanical transducer adapted for use in an electric drum and comprising first and second conductive members in surface contact with and spaced by an electroconductive material impregnated resilient dielectric matrix defining a hit pressure responsive variable resistance medium between the members.

In a further embodiment there is provided in a drum having a drum head, a variable resistance electromechanical transducer at least partially contiguous with the drum head and comprising first and second conductive members in surface contact with and spaced by a carbon impregnated resilient, dielectric, synthetic organic polymer matrix defining a drum head hit pressure responsive, variable resistance medium between the members.

In yet another embodiment there is provided in accordance with the invention for the reproduction of drum hits selectively in an environment of spurious acoustic energy, the combination comprising the above-defined transducer, and a drum in operative association therewith, the transducer being selectively responsive to drum hits to vary inversely the resistance and current in a circuit including the transducer in drum hit signal generating relation.

In each of the foregoing embodiments, the matrix may be impregnated with particulate carbon, preferably, or with conductive metal. The matrix itself typically comprises a synthetic organic polymer which may define a multiplicity of interior voids, e.g. as a result of foaming the polymer. Preferably the matrix comprises an open cell urethane polymer foam which is preferably impregnated with particulate carbon.

Of the mentioned conductive members at least one thereof typically comprises a metallic foil, e.g. copper or aluminum, or copper or aluminum screening. In a particularly preferred arrangement, the matrix is impregnated with carbon and comprises synthetic organic polymer foam, while the conductive members comprise copper foil and screening respectively.

Alternatively the matrix may be cellulosic, and combined with the impregnants and conductive members as aforesaid.

In a highly preferred embodiment of the invention there is provided in a drum having a drum head, a variable resistance electromechanical transducer at least partially contiguous with the head, and comprising first and second conductive members in surface contact with and spaced by a carbon impregnated resilient, dielectric, synthetic organic polymer matrix defining a drum head hit pressure responsive, variable resistance medium between the members. Typically in this and like embodiments, the medium comprises the product of the deposit of carbon on the interior pore surfaces of the matrix, said deposit being by means of a liquid vehicle comprising a film forming agent and a solvent therefor; the conductive members comprise copper or aluminum or other metallic foil or screening; the matrix is formed at least in part of an open cell foam of the synthetic organic polymer, which preferably is urethane polymer and combined with conductive members which are copper or aluminum screening or foil, the medium preferably having an electrical resistance between 2 K and 10 Kohms at ten pounds per square inch gage pressure.

Thus, for the reproduction of drum hits selectively in an environment of spurious acoustic energy, the invention provides the combination comprising the transducer defined above, and a drum in operative association therewith, the transducer being selectively responsive to drum hits to vary inversely the resistance and current in a circuit including the transducer, in drum hit signal generating relation.

In still another embodiment, the invention provides an electric drum adapted for sound generation substantially exclusively from direct hit inputs selectively in an environment of spurious acoustic energy inputs, the drum comprising a drum head extended over the open end of a drum chamber, and a variable resistance electromechanical transducer in operative contact with the drum head, the transducer comprising a first conductive member at least partially contiguous with the drum head and deflectably co-responsive to hits on the head, a second conductive member, and a variable resistance, resilient medium sandwiched between the members; the medium comprising a dielectric synthetic organic polymer and electroconductive particles distributed therethrough in variable resistor defining relation, the medium being temporarily locally responsive to head direct hit inputs to the surface of the transducer in medium resistance varying relation and substantially nonresponsive to concomitant acoustic energy inputs.

As in previous embodiments, the medium matrix may be impregnated with carbon black or particulate metal and the polymer matrix define a multiplicity of interior voids, as by being foamed. Preferred again is a urethane polymer foam matrix, particularly when the electroconductive particles comprise particulate carbon. The conductive members comprise copper or aluminum and preferably the first conductive member comprises screening and the second, opposed conductive member a foil, with the intervening medium matrix of synthetic organic polymer foam being impregnated with carbon black. The medium preferably comprises the product of the evaporative deposit of carbon through a foam comprising the synthetic organic polymer matrix, from a liquid vehicle which may comprise an adhesive agent such as a film forming resin and a solvent therefor. Thus the carbon may be lamp black, and the vehicle a liquid hydrocarbon nonsolvent for the matrix polymer present in an amount sufficient to suspend the lamp black in matrix polymer foam dispersible relation.

There is thus realized in accordance with the teaching of the invention, an electric drum, comprising a drum head extended over the open end of a drum chamber, and an electromechanical transducer including a synthetic organic polymer open cell foam body, the body being impregnated with carbon and defining an electrical resistance variable in response to drum head hits in acoustic coupling free relation. The electromechanical transducer includes conductive members sandwiching the foam body, one of which is copper screening at least partially contiguous with the drum head. Preferably the polymer foam body is substantially coextensive with the drum head, the head contiguous one of said conductive means being interposed between the drum head and the foam in drum head deflecting hit transmitting relation. Preferably the other conductive member comprises copper foil supported on a backing material. The electromechanical transducer is preferably located within the drum body and substantially coextensive with the hit area of the drum head.

In the particular embodiment of the invention illustrated in the drawings herein, the invention comprises an electric drum comprising a generally cylindrical drum body having an open end and an externally threaded portion below the body open end, a tensioning member circumscribing the drum body in relatively axially adjustable threadedly engaged relation, said tensioning member including an inturned flange; a synthetic organic polymer drum head disposed upon the drum body open end, the drum head having a perimetrical means for engaging the tensioning member flange in tautness determining relation upon thread controlled axial adjustment of the drum body and tensioning member; a generally flat, circular electromechanical transducer comprising a first circular conductive member comprising metal screening contiguous with the inward side of said drum head, a second circular conductive member coaxial with and spaced from the first conductive member, the second conductive member comprising a metal foil supported on a backing, and sandwiched between the first and second conductive members a disc shaped dielectric matrix comprising urethane polymer foam impregnated with carbon in variable resistance defining relation responsive to direct pressure; the transducer being supported within the drum body in direct drum head hit receiving relation for generation of a signal responsive to direct hit reception.

The invention further contemplates in the method of electrically picking up hits on an electric drum for sound reproduction by varying the electrical resistance of a particulate resistive mass, the improvement comprising resiliently supporting the components of said particulate mass in a direct hit energy responsive and acoustic coupling damping matrix comprising a synthetic organic polymer foam to block resistance varying pick-up of concomitant acoustic energy in the vicinity of the drum while responding to direct drum hits.

BRIEF DESCRIPTION OF THE DRAWINGS

The invention will be further described as to an illustrative embodiment thereof in conjunction with the attached drawings wherein.

In each Figure the oscilloscope operating parameters are set down on the respective axes.

Figure 9:
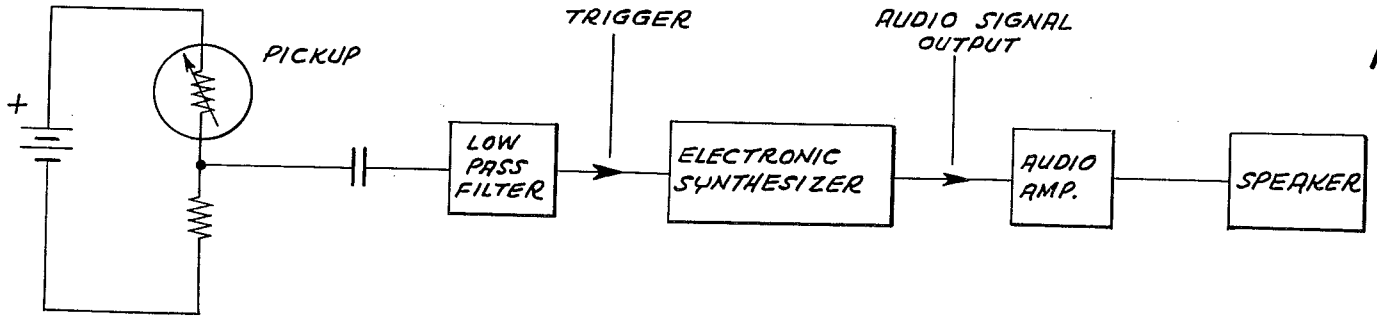

FIG. 9 is a block diagram of the present electric drum apparatus.

DESCRIPTION OF THE PREFERRED EMBODIMENTS

Figure 1:
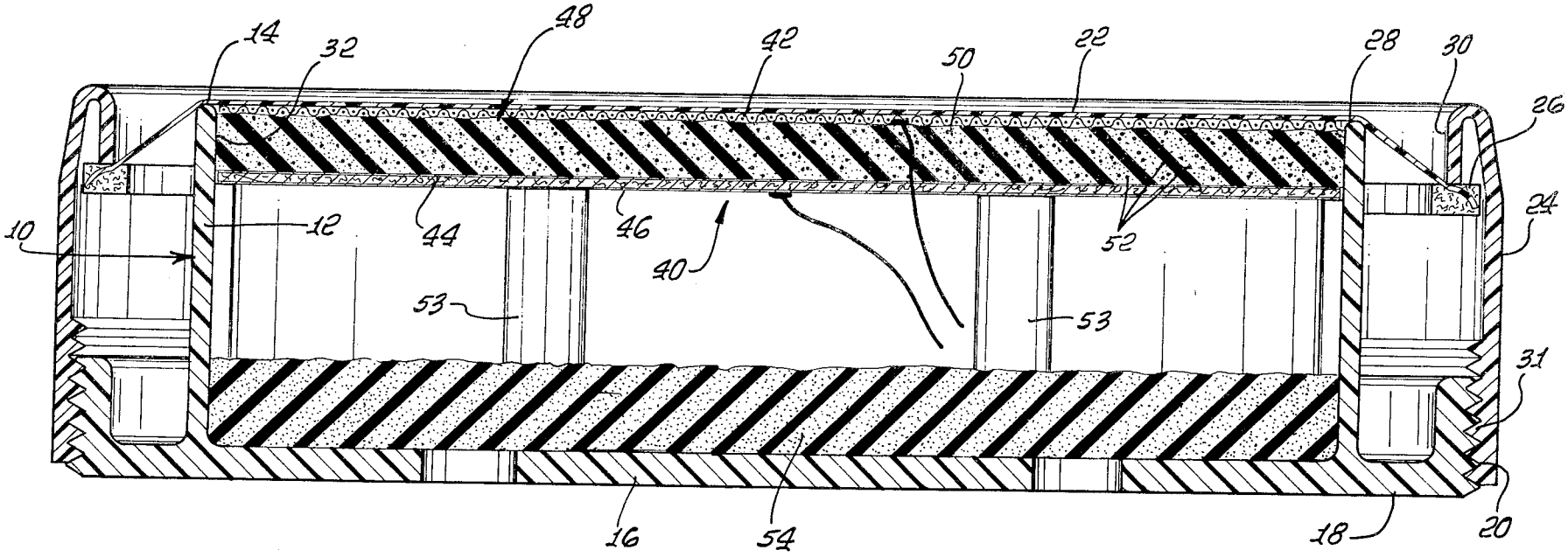
FIG. 1 is a view in vertical section of an electric drum having the acoustic coupling free pick-up of the invention.

One need go no further than the just mentioned FIGS. 2 through 8 to realize the dramatic reduction in acoustic coupling response achieved with the present invention, and with no sacrifice in, indeed an improvement in the direct hit sensitivity and response. In obtaining this data, a pair of electric drums having identical molded housings as illustrated in FIG. 1 were mounted side by side on a conventional stand and with a pair of non-electric tom drums directly below them. One drum was equipped with a Kevlar head sold by Duraline and an electromechanical transducer according to the present invention. The second drum was equipped with a Mylar drum head sold by Syndrum, and a standard 8 ohm speaker on the pick-up unit.

Figure 2:
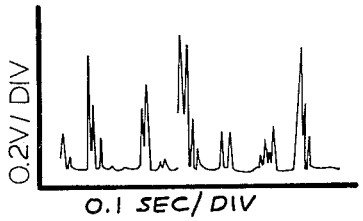
PRIOR ART FIG. 2
FIGS. 2 and 5 are each oscilloscope traces of acoustic response characteristics of a conventional prior art electric drum pick-up arrangement (FIG. 2) and of the electric drum and transducer arrangement of the present invention (FIG. 5).

Acoustic coupling response was evaluated by striking the tom located just below the test electric drum, and after connecting the electric drum to a power supply, recording the change in current as a measure of resistance varying response. The tom was struck three times with a drum stick. FIG. 2 reveals that the conventional pick-up unit is highly sensitive to adjacent noise, indeed almost as sensitive to such noise as to a direct hit. Such sensitivity requires that the electric drum and drummer, be placed in a remote area, or that sensitivity be lowered electronically with resultant loss of musical values in direct hit response, or some other equally unsuitable expedient be employed.

Figure 5:
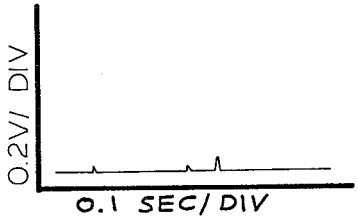

Note, however, that with the present invention arrangement the response of the pick-up to three hits on the subsequent tom is negligible, i.e. in FIG. 5.

Figure 3:
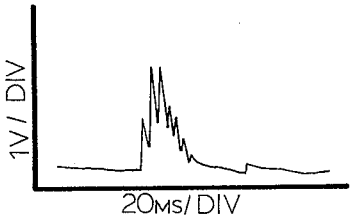
FIGS. 3 and 6 are each oscilloscope traces of direct hit response characteristics of a conventional, prior art electric drum pick-up arrangement (FIG. 3) and the electric drum and transducer arrangement of the present invention (FIG. 6).
Figure 6:
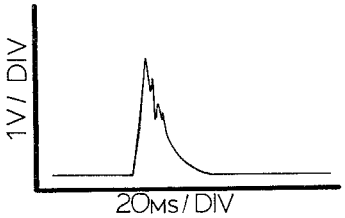

In FIG. 3, a direct hit with a drum stick on the conventional electric drum head is recorded. A sharp spike with rising and descending shoulders shows the profile of the resulting vibration. In FIG. 6, a like strike on the invention electric drum produces a cleaner spike with fewer shoulders and less area under the spike for an improved note.

Figure 4:
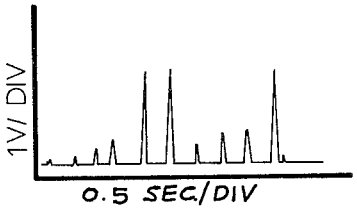
FIGS. 4 and 7 are each oscilloscope traces of combined acoustic coupling and direct hit response characteristics of a conventional, prior art electric drum pick-up arrangement (FIG. 4) and of the electric drum and transducer arrangement of the present invention (FIG. 7); and in FIG. 8 are simultaneous oscilloscope traces of prior art pick-up (upper line) and invention pick-up (lower line) showing the acoustic coupling response of each to adjacent and remote hits on conventional drums placed side by side below their respective electric drums.
Figure 7:
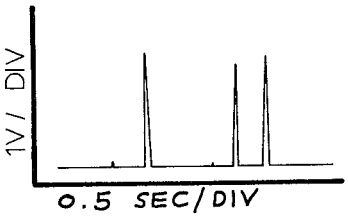

In FIGS. 4 and 7 three hits directly on the respective prior art and invention drum heads, each in an environment of spurious acoustic energy generated by striking the subjacent tom at each electric drum were made. The contrast in response is remarkable. The FIG. 7 profile of the invention electric drum shows clean sharp spikes with negligible background noise pick-up from acoustic coupling with tom noise. The FIG. 4 profile, however, reveals numerous small acoustic coupling spikes in addition to the direct hit spikes, which former muddy the percussion output of the drum which reaches the listener, from the intended distinctness.

Figure 8:
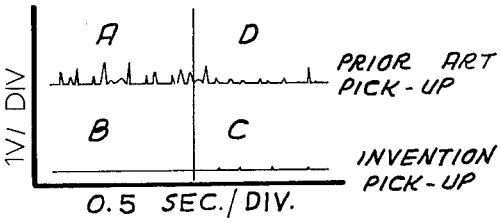

FIG. 8 provides a side by side demonstration of the invention pick-up and prior art. The test set-up had two conventional drum side by side and two electric drums, also side by side, one above each of the conventional drums in a common playing arrangement. The right-hand electric drum was equipped with a prior art pick-up and the left-hand electric drum with the pick-up of the invention. Simultaneous dual traces were made of the electric drums pick-up from alternate striking of the conventional drums. Then the right-hand conventional drum was struck first and the effect on the prior art pick-up just above that drum traced in portion A of the upper trace in FIG. 8. Simultaneously, the effect on the invention pick-up of that same strike was traced in portion B of the lower trace in FIG. 8. There was no response.

Conversely, when the left-hand conventional drum, located just below the invention pick-up was struck, there was a minor response by the invention pick-up, (see portion C of the lower trace in FIG. 8), but a larger and more persistent response by the more remote, prior art pick-up, as shown in portion D of the upper trace. The difference in spurious input response in dramatically seen by diagonally cross-comparing the traces, i.e. portion A versus portion C, showing the different response to directly subjacent drum hits; and portion D versus portion B, showing the different response to laterally subjacent drum hits.

The graphically illustrated breakthrough just described enables higher sensitivity settings on electric drums and electronic synthesizers used therewith, location of percussion instruments and their players for optimum artistic effect without fear of mottling other musical values in performances, and more controllable sound generation.

An illustrative embodiment of the present electric drum is shown in FIG. 1. Like the drums used in the foregoing tests, the FIG. 1 drum is seen to have a drum body 10 comprising a cylindrical wall 12 surface rounded at rim 14 and provided with a planar base 16 apertured to receive a tightening tool (not shown) and extended beyond wall 12 to define a perimetrical flange 18 peripherally externally threaded at 20.

A drum head 22 is stretched taut over drum rim 14 by tensioning member 24. A bead 26 of resin, metal or the like suitably adhered or anchored to the peripheral edge of generally circular head 22 beyond drum head shoulder 28 is engaged by internal flange 30 of the tensioning member. Tensioning member 24 defines an internally threaded base portion 31 which cooperatively with body threads at 20 axially relatively adjusts the body 10 and member 24 to draw the head 22 downward and outward and more or less taut across the drum body opening 32 as needed. This tautness adjustability has value for controlling the sensitivity of the pick-up as described hereinafter. As thus far described, the drum is conventional. Typically a speaker cone type pick-up is installed at or on the body base 16 and vibrations generated by hitting the drum head 22 are picked up, translated into changes in current by the pick-up and used as sound reproduction signals. The mode of pick-up is acoustic coupling as will be evident, and thus it is not suprising that spurious acoustic energy, i.e. energy not directly from a drum head hit is picked-up and itself become a signal.

In a marked departure from previous efforts of workers in the art, there is provided here a drum pick-up which does not employ acoustic coupling for pick-up purposes and which avoids the problems of such devices entirely.

Again with reference to FIG. 1 an electromechanical transducer, generally indicated at 40 is provided. The transducer 40 comprises a first, upper conductive member suitably copper or aluminum screening 42, a second, lower conductive member, suitably copper, aluminum or other metal foil 44 supported on a particle board 46 or like support and sandwiched between these conductors a dielectric matrix 48, e.g. urethane polymer foam 50 which has been impregnated with electroconductive particles 52, typically lampblack dispersion into the voids of the foam to be variably resistant depending on pressure. A typical impregnated foam 50 will contain from 0.01 to 25% and preferably 1 to 5% by weight carbon and have a resistance of 2 K to 10 Kohms at 10 pounds per square inch gage pressure. This is a benchmark value only and smaller or greater restivity values can be used, as can various response rates to pressure.

The foam sandwich is supported by molded internal pilasters 53 and operates by deflection of the head 22, the screen conductive member 42 and the foam 50, resulting in a change in resistance and thus a current flow increase (by virtue of a constant voltage supply not shown) from conductive member to conductive member generating a signal. See FIG. 9.

A non-impregnated foam layer 54 is placed on the drum body base 16 to cover the same. Loosening head 22 tautness reduces the sensitivity of the transducer to hit pick-up.

The transducer 40 may be fully or less than fully contiguous with the drum head; the drum head may be any material or synthetic organic polymer material used or useful as a vibratile membrane, e.g. Mylar (polyethylene terephthalate) or Kevlar (polyaramide) of requisite properties. Other forms of drum bodies than that shown may be used with like advantageous effect. Conductive member 42, 44 can be any of the various conductive metals with plates, foils, reticulated foils, screens and other forms all being useful. If the conductive member is not sufficiently self-supporting, support may be provided as noted. The matrix is preferably urethane foam but other dielectric materials, e.g. cellulosic, or other synthetic organic polymers may be used, e.g. olefin polymer fibers or foams, phenolic foams and the like. Electroconductive particles therein are preferably carbon but particulate metals may be used, e.g. copper, aluminum, silver and the like. Semiconductive polymers having the requisite degree of sensitivity may be employed as the medium between conductors as well.

I claim:

1. In combination a drum having a drum head and a variable resistance electromechanical transducer substantially contiguous with said head and comprising first and second conductive members is surface contact with and spaced by a carbon impregnated resilient, dielectric, synthetic organic polymer matrix defining a drum head hit pressure responsive, variable resistance medium between said members in acoustic coupling free relation.

2. Variable resistance electromechanical transducer according to claim 1, in which said medium comprises the product of the deposit of carbon on the interior pore surfaces of said matrix.

3. Variable resistance electromechanical transducer according to claim 2 in which said deposit is by means of a liquid vehicle comprising a film-forming agent and a solvent therefor.

4. Variable resistance electromechanical transducer according to claim 1, in which said conductive members comprise copper or aluminum.

5. Variable resistance electromechanical transducer according to claim 1, in which at least one of said conductive members comprises metallic foil.

6. Variable resistance electromechanical transducer according to claim 1, in which at least one of said conductive members comprises copper or aluminum screening.

7. Variable resistance electromechanical transducer according to claim 1, in which said matrix is formed at least in part of an open cell foam of said synthetic organic polymer.

8. Variable resistance electromechanical transducer according to claim 7, in which said synthetic organic polymer comprises urethane polymer.

9. Variable resistance electromechanical transducer according to claim 8, in which at least one of said conductive members is copper or aluminum screening or foil.

10. Variable resistance electromechanical transducer according to claim 1, in which the electrical resistance of said medium is between 2 K and 10 Kohms at ten pounds per square inch gage pressure.

11. An electric drum adapted for sound generation substantially exclusively from direct hit inputs selectively in an environment of spurious acoustic energy inputs, said drum comprising a drum head extended over the open end of a drum chamber, and a variable resistance electromechanical transducer in operative contact with said drum head, said transducer comprising a first conductive member substantially contiguous with said drum head and deflectibly co-responsive to hits on said head, a second conductive member, and a variable resistance, resilient medium sandwiched between said members, said medium comprising a dielectric synthetic organic polymer matrix and electroconductive particles distributed therethrough in variable resistor defining relation, said medium being temporarily locally responsive to head direct hit inputs to the surface of said transducer in medium resistance varying relation and substantially non-responsive to concomitant acoustic energy inputs.

12. Transducer according to claim 11 in which said matrix is impregnated with particulate carbon.

13. Transducer according to claim 11 in which said matrix is impregnated with particulate metal.

14. Transducer according to claim 11 in which said matrix polymer defines a multiplicity of interior voids.

15. Transducer according to claim 14 in which said matrix polymer has been formed to provide said voids.

16. Transducer according to claim 15 in which said polymer foam is an open cell urethane polymer foam.

17. Transducer according to claim 16 in which said electroconductive material comprises particulate carbon.

18. Transducer according to claim 11 in which said conductive members comprise copper or aluminum.

19. Transducer according to claim 11 in which the first of said conductive members comprises copper or aluminum screening.

20. Transducer according to claim 11 in which the second of said conductive members comprises a metallic foil.

21. Transducer according to claim 20 in which said matrix is impregnated with particulate carbon.

22. Transducer according to claim 21 in which said matrix comprises synthetic organic polymer foam.

23. Transducer according to claim 22 in which said conductive members each comprise copper.

24. Electric drum according to claim 11, in which said medium comprises the product of the evaporative deposit of carbon from a liquid vehicle through a foam comprising said synthetic organic polymer matrix.

25. Electric drum according to claim 24, wherein said liquid vehicle comprises an adhesive agent and a solvent therefor.

26. Electric drum according to claim 25, in which said carbon is lamp black, and said vehicle is a liquid hydrocarbon non-solvent for said polymer present in an amount sufficient to suspend said lamp black in polymer foam dispersible relation.

27. An electric drum, comprising in combination a drum head extended over the open end of a drum chamber, said drum head being substantially contiguous with an electromechanical transducer comprising a synthetic organic polymer open cell foam body, said body being impregnated with carbon and defining an electrical resistance variable in response to drum head hits in acoustic coupling free relation.

28. Electric drum according to claim 27, including also conductive members sandwiching said foam body, one of which is copper screening at least partially contiguous with said drum head.

29. Electric drum according to claim 28, in which said polymer foam body is substantially coextensive with said drum head, the head contiguous one of said conductive means being interposed between said drum head and said foam in drum head deflecting hit transmitting relation.

30. Electric drum according to claim 29, in which the other of said conductive members comprises copper foil supported on a backing material.

31. Electric drum according to claim 30, in which said transducer is located within said drum chamber.

32. Electric drum according to claim 31, in which said transducer is substantially co-extensive with the hit area of said drum head.

33. An electric drum comprising a generally cylindrical drum body having an open end and an externally threaded portion below said open end, a tensioning member circumscribing said drum body in relatively axially adjustable threaded engaged relation, said tensioning member including an inturned flange; a synthetic organic polymeric drum head disposed upon the drum body open end, said drum head having perimetrical means for engaging said tensioning member flange in tautness determining relation upon thread controlled axial adjustment of the drum body and tensioning member; a generally flat, circular electromechanical transducer comprising a first circular conductive member comprising metal screening contiguous with the inward side of said drum head, a second circular conductive member coaxial with and spaced from said first conductive member, said second member comprising a metal foil supported on a backing, and sandwiched between said first and second conductive members a disc shaped dielectric matrix comprising urethane polymer foam impregnated with carbon in variable resistance defining relation responsive to direct pressure, said transducer being supported within the drum body in direct drum head hit receiving relation for generation of a signal responsive to direct hit reception and in acoustic coupling free relation.

* * * * *